US007152555B2

(12) United States Patent
Langervik

(10) Patent No.: US 7,152,555 B2
(45) Date of Patent: Dec. 26, 2006

(54) ENGINE COOLING SYSTEM

(75) Inventor: Dennis Langervik, Greensboro, NC (US)

(73) Assignee: Volvo Trucks North America, Inc., Greensboro, NC (US)

( * ) Notice: Subject to any disclaimer, the term of this patent is extended or adjusted under 35 U.S.C. 154(b) by 126 days.

(21) Appl. No.: 10/979,711

(22) Filed: Nov. 2, 2004

(65) Prior Publication Data

US 2005/0061264 A1 Mar. 24, 2005

Related U.S. Application Data

(60) Continuation-in-part of application No. 10/360,156, filed on Feb. 6, 2003, now Pat. No. 6,886,503, which is a division of application No. 09/788,874, filed on Feb. 20, 2001, now Pat. No. 6,532,910.

(51) Int. Cl.
*F01P 7/00* (2006.01)

(52) U.S. Cl. ..... 123/41.08

(58) Field of Classification Search ..... 123/41.01, 123/41.08, 41.09, 41.13, 41.22, 41.54; 137/480, 137/517, 512.5; 73/117.1, 117.2, 117.3, 73/118.1, 118.2

See application file for complete search history.

(56) References Cited

U.S. PATENT DOCUMENTS

| | | | | |
|---|---|---|---|---|
| 2,191,611 | A | 2/1940 | Esbaugh et al. | |
| 3,162,182 | A | 12/1964 | Gratzmuller | |
| 3,256,868 | A | 6/1966 | Gratzmuller | |
| 3,576,181 | A | 4/1971 | Neal et al. | |
| 4,478,178 | A | 10/1984 | Pernet | |
| 4,510,893 | A | 4/1985 | Schweiger et al. | |
| 4,565,162 | A | 1/1986 | Seki et al. | |
| 4,608,827 | A | 9/1986 | Hasegawa et al. | |
| 4,640,235 | A | 2/1987 | Martin | |
| 4,649,869 | A | 3/1987 | Hayashi et al. | |
| 4,669,426 | A | 6/1987 | Hirano et al. | |
| 4,722,305 | A | 2/1988 | Haskell | |
| 4,782,689 | A | 11/1988 | DeRome | |
| 4,913,107 | A | 4/1990 | Schweiger | |
| 4,928,637 | A | 5/1990 | Naitoh et al. | |
| 4,930,455 | A | 6/1990 | Creed et al. | |
| 4,958,600 | A | 9/1990 | Janthur | |
| 5,036,888 | A | 8/1991 | Scharrer et al. | |
| 5,044,430 | A | 9/1991 | Avrea | |
| 5,111,777 | A | 5/1992 | Steinberg et al. | |
| 5,186,242 | A | 2/1993 | Adachi et al. | |
| 5,241,926 | A | 9/1993 | Sato et al. | |
| 5,289,803 | A | 3/1994 | Matsushiro et al. | |
| 5,520,209 | A * | 5/1996 | Goins et al. | 137/246 |
| 5,666,911 | A | 9/1997 | Gohl et al. | |
| 5,809,944 | A | 9/1998 | Aoki et al. | |
| 5,836,269 | A | 11/1998 | Schneider | |
| 5,899,266 | A | 5/1999 | Szucs | |

(Continued)

FOREIGN PATENT DOCUMENTS

| | | |
|---|---|---|
| DE | 2222919 | 11/1972 |

(Continued)

*Primary Examiner*—Hai Huynh
(74) *Attorney, Agent, or Firm*—Martin Farrell

(57) ABSTRACT

An improved cooling system for a turbo charged internal combustion engine is disclosed. A conduit connects a pressurizing engine air intake to the cooling system to raise the pressure in the cooling system thereby enabling an increase of the maximum temperature which coolant in the cooling system can reach. An electronically controlled valve selectively places the expansion tank in communication with the pressurizing engine air intake to maintain a desired pressure in the tank and to prevent back flow of fluid into the engine air intake.

26 Claims, 4 Drawing Sheets

U.S. PATENT DOCUMENTS

| | | | | |
|---|---|---|---|---|
| 6,016,774 | A | 1/2000 | Bokkers et al. | |
| 6,053,132 | A | 4/2000 | Evans | |
| 6,135,067 | A | 10/2000 | Klamm et al. | |
| 6,213,062 | B1 | 4/2001 | Kawase | |
| 6,244,294 | B1 | 6/2001 | Hollis | |
| 6,276,312 | B1 * | 8/2001 | Summan et al. | 123/41.54 |
| 6,666,175 | B1 * | 12/2003 | Wand et al. | 123/41.01 |
| 7,000,467 | B1 * | 2/2006 | Chu et al. | 73/299 |

FOREIGN PATENT DOCUMENTS

| | | |
|---|---|---|
| EP | 360252 | 9/1989 |
| EP | 520135 | 2/1992 |
| GB | 1355767 | 6/1974 |
| GB | 2175997 | 5/1986 |
| JP | 63-85215 | 4/1988 |
| JP | 2-294515 | 12/1990 |
| SU | 1211-422 | 7/1984 |
| SU | 1218-160 | 9/1984 |
| SU | 1204757 | 1/1986 |

* cited by examiner

ENGINE COOLING SYSTEM

RELATED BACK

This is a Continuation-in-Part application of U.S. Ser. No. 10/360,156, filed on Feb. 6, 2003, which is a divisional application of U.S. Ser. No. 09/788,874, filed Feb. 20, 2001.

TECHNICAL FIELD

This invention relates to engine cooling systems and more particularly to a novel and improved cooling system in an internal combustion engine.

BACKGROUND ART

The development of internal combustion engines for reduced exhaust emissions has resulted in significant increases in the amount of heat dissipation into engine cooling systems.

Traditionally, increases in the required amount of heat dissipation has been accomplished by improving the radiator cooling capacity through increasing the core size of the radiator. In addition, increased coolant and cooling air flow have been used to deal with the increase in required heat dissipation.

Packaging space for larger radiator cores and high energy consumption due to increased coolant and cooling air flow limit the amount of heat dissipation capacity increase that can be accomplished with these traditional approaches.

It is possible to improve cooling capacity by elevating the maximum permissible coolant temperature above traditional levels. The adoption of pressurized cooling systems which permitted operation with coolants up to 100° C./212° F. was a step in this direction. The addition of expansion tanks assisted in maintaining such temperature levels. However, it has become desirable to elevate coolant temperatures to even higher levels.

Utilization of elevated coolant temperatures requires proper pressurization under all operating, stand-still and ambient conditions in order to control cooling characteristics, secure coolant flow, prevent cavitation and cavitation erosion and to prevent unwanted boiling and overflow.

Temperature and pressure increase becomes more critical as the heat dissipation from the engine approaches the cooling capacity of the cooling system. A now traditional approach for pressurizing cooling systems is to rely on closed expansion or pressure tanks which depend on temperature increases of coolant and air to create and maintain desired pressures. Such a system communicates with ambient air by opening two way pressure valves thereby communicating the system with ambient air to entrain new air into the pressure tank when entrapped air and the coolant cool to create a vacuum in the system. Such systems are passive and vulnerable to leaks. Moreover, if such a system is depressurized for any reason, such as maintenance or top-off, pressure is reduced to ambient and operating time and cycles are needed to increase the pressure in the system.

In order to facilitate operation at higher pressure (and higher coolant temperature) some coolant systems employ an external pressure source such as the charge air system of the vehicle that is coupled to the expansion tank to boost cooling system pressure above that possible with passive systems. These systems typically use pressure relief and pressure control to the ambient atmosphere, that causes constant or frequent air flow through to the tank or pressure source resulting in oxidization of coolant and scavenging. In addition, the external pressure is constantly applied, resulting in parasitic losses at the pressure source.

SUMMARY OF THE INVENTION

According to the present invention, an internal combustion engine cooling system is pressurized by introducing air under pressure from an external pressurized source. More specifically, in the preferred and disclosed embodiment, air under pressure from an engine intake manifold is communicated into the cooling system to thereby pressurize the system and elevate the maximum available coolant temperature. In its simplest form, a conduit connects an engine intake manifold with a cooling system expansion tank via a flow control check valve. The flow control valve is in the form of a spring loaded non-return valve connected in the conduit for enabling unidirectional flow from the intake manifold to the expansion tank.

In an alternate embodiment, a flow control valve in the form of a spring loaded non-return valve is also used. A second spring loaded non-return valve allows decompression of the expansion tank to a threshold pressure level corresponding to the spring pressure of the second valve plus the pressure in the engine air inlet system. In order to dampen decay of pressure in the coolant system, a restrictor is interposed in series with the second non-return valve.

A further alternative includes a valve, such as for example a floating check valve or electronically controlled valve, between the expansion tank and the conduit that is actuated based on a level of coolant liquid in the expansion tank to block flow of coolant to the pressure source when the tank level reaches a predetermined limit.

A further alternative includes an electric or pneumatic switch between the restrictor and the second non-return valve. A control algorithm for this switch is based on coolant pressure, temperature, engine load parameters and duty cycles for optimizing the expansion tank pressure.

In a still further alternative, a two directional two way control valve is used together with pressure sensors respectively located on opposite sides of the control valve. A control algorithm for pressure control is based on selected parameters such as coolant pressure, engine load, charge air pressure, coolant temperature, ambient temperature and pressure, cooling system capacity, cooling fan speed and duty cycles. A pressure control range is calculated based on the selected parameters and the valve is actuated to maintain pressure within the control range.

The alternate embodiments using electronic control units enable diagnosis of the systems actual functioning condition. The system compares actual pressure levels, time temperatures and valve positions with expected critical pressures under given conditions in the setting and design parameters for the system and components used in it. Diagnostic information is available for drivers and service information. It also can be used for actively changing the functioning of the system to enable continued use of the engine vehicle in a so-called limp home mode in case of system malfunction.

Accordingly, the objects of this invention are to provide a novel and improved engine coolant system and a method of engine cooling.

DESCRIPTION OF THE PREFERRED EMBODIMENTS

Figure 1:
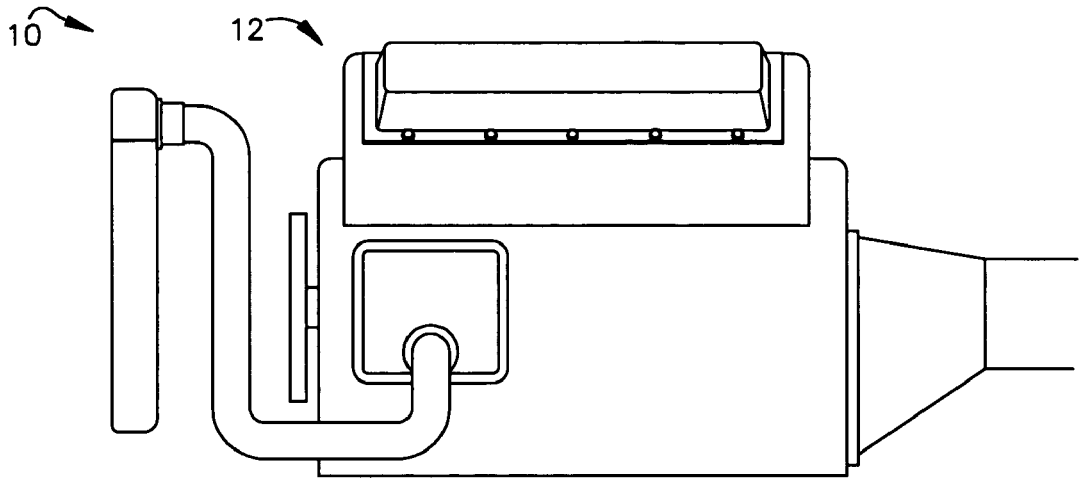
FIG. 1 is a schematic view of a turbo charged engine and cooling system for an over the highway heavy duty truck or tractor made in accordance with the present invention.

Referring to the drawings and FIG. 1 in particular, a schematic of an engine and cooling system for an over the highway truck or tractor is shown generally at 10. The truck is equipped with a turbo charged engine 12. As shown somewhat schematically in FIG. 2 the engine 12 is equipped with a cylinder head 14 having an air intake manifold 15. The engine 12 is equipped with a turbo charger pressurizing the intake manifold 15 as shown schematically at 16 in FIG. 2.

Figure 2:
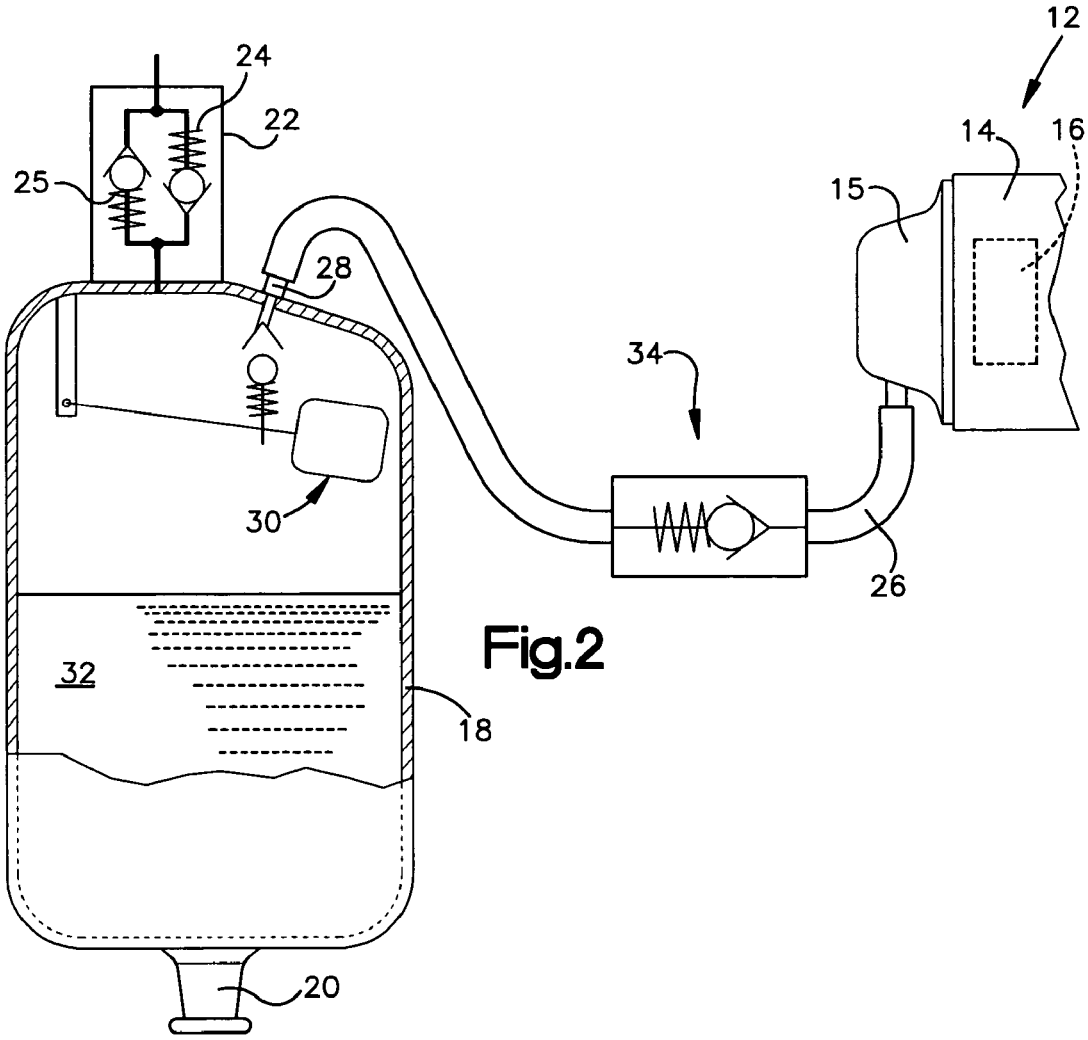
FIG. 2 is a schematic view of one embodiment of the novel portions of the cooling system of the present invention.

The engine 12 is equipped with a cooling system which includes an expansion tank 18, FIG. 2. The expansion tank 18 is a standard tank including an outlet 20 connected to an inlet of a water or coolant pump. The tank 18 includes a fill opening equipped with a pressure cap 22. In the disclosed embodiment, the cap 22 includes a tank pressure relief and coolant overflow valve 24 and a vacuum relief valve 25 as is now conventional in coolant systems.

A conduit 26 connects the intake manifold 15 to the expansion tank 18. The conduit 26 communicates with the expansion tank 18 through an inlet 28. A floating check valve 30 functions to control unidirectional fluid flow through the inlet 28 when a level of coolant 32 in the tank 18 rises to a higher level than that depicted in FIG. 2. Thus, the check valve 30 functions to prevent coolant 32 from entering the conduit 26.

A flow control valve 34 is interposed in the conduit 26. In its simplest form, the flow control valve is a simple spring loaded non-return valve which allows pressurized flow from the manifold 15 to the tank 18, but prevents reverse flow of pressurized fluid from the tank 18 to the manifold 15.

With the embodiment of FIG. 2, the tank pressure relief valve 24 will control the pressure in the cooling system. So long as the pressure level at which the tank pressure relief valve operates is higher than the pressure in the system, the operating pressure in the system will always be above the opening pressure of the flow control valve and below the tank pressure relief valve's opening pressure due to the one way functioning of the flow control valve 34.

Figure 3:
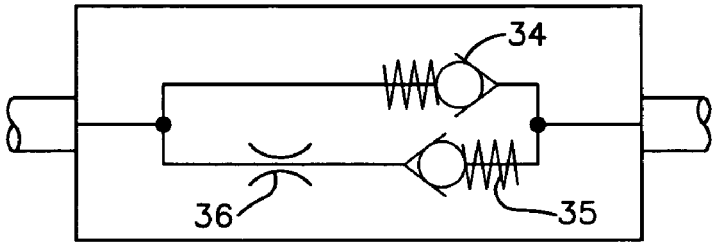
FIG. 3 is a schematic showing of an alternate flow control valve arrangement for the system of FIG. 2.

In the embodiment of FIG. 3, a second valve in the form of another spring loaded non-return valve 35 is provided. The valve 35 allows decompression of the expansion tank pressure down to a threshold pressure level corresponding to the spring pressure of the valve 35 plus the pressure of the engine air inlet system. In order to dampen the pressure decay in the cooling system, a restrictor 36 is in series with the second flow control valve 35. In FIG. 3, the restrictor is shown on the coolant side of the valve but it could be on the engine side.

Figure 4:
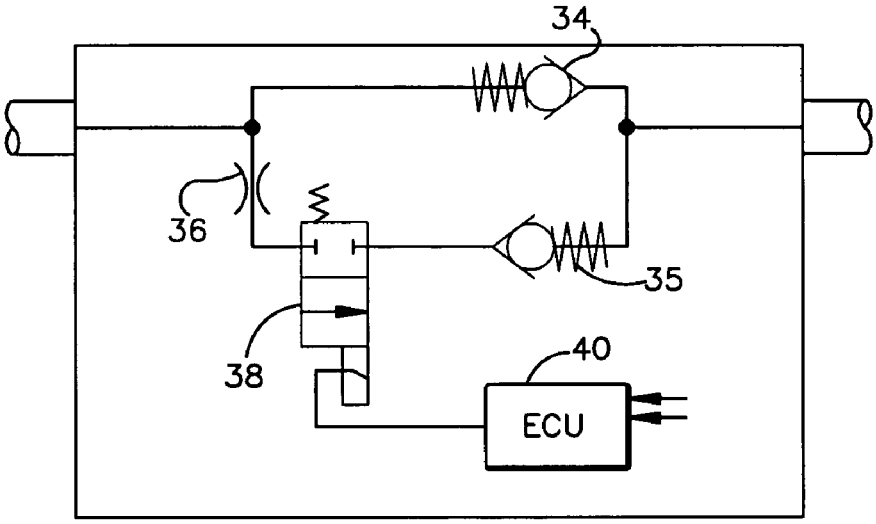
FIG. 4 is a further alternate arrangement of the flow control valving for the system of FIG. 2.

With the embodiment of FIG. 4, a directional control flow valve 38 is added to the system in series with the restrictor 36 and the second or decompression control valve 35. The directional control valve 38 functions to prevent automatic pressure decay in the expansion tank by maintaining a higher pressure when the engine load and the pressure in the engine intake system is reduced.

An electronic control unit 40 controls the positioning of the directional control valve. The control algorithm for this function is based on coolant pressure, temperature, engine load parameters, and duty cycles relevant for optimizing the expansion tank pressure. Alternatively, a pneumatic switch may be substituted for the electrically controlled directional control valve that has been described.

Figure 5:
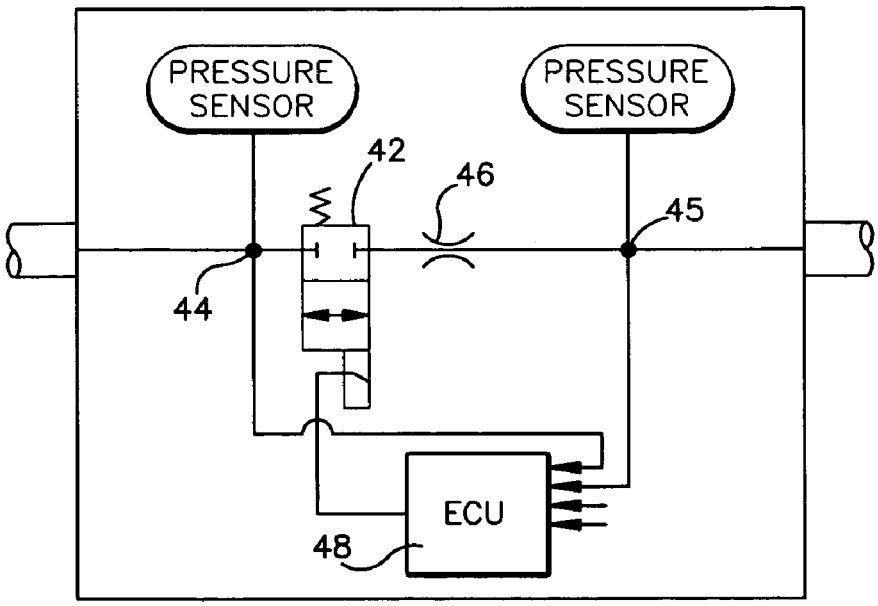
FIG. 5 is a schematic view of yet another alternate flow control valving arrangement for the system of FIG. 2.

FIG. 5 discloses an alternative which offers full flexibility in building up and maintaining pressure in the expansion tank 18 and therefore in the coolant system. The alternate of FIG. 5 includes control of pressure variations and amplitudes. The system of FIG. 5 utilizes a two directional, two way control valve 42. Pressure sensors 44,45 are respectively positioned between the one way valve 42 and the expansion tank 18 and between the one way valve and the engine intake manifold 15. A restrictor 46 is interposed in series with the direction control valve 42 and the pressure sensor 45.

The direction control valve 42 is controlled by an electronic control unit 48. A control algorithm for the control unit 48 is based on selected parameters such as coolant pressure, engine load, charge pressure, coolant temperature, ambient temperature, ambient pressure, cooling system capacity, cooling fan speed, and duty cycles. The pressure in the expansion tank is optimized by actively pressurizing to satisfy coolant system function. While the pressure is optimized, it is raised to no higher than necessary pressure levels and with pressure variations and amplitudes which match the properties of materials used in the coolant system.

A passive pressure build-up in the expansion tank will take place naturally and in parallel with the active pressure control systems that have been described. How the passive pressure build-up will interact depends on which of the embodiments is employed.

The embodiments of FIGS. 4 and 5 make it possible to diagnose a system's actual functioning condition and to identify problems. Such a system compares actual pressure levels, time, temperatures and valve positions with expected critical pressures under given conditions and the setting of design parameters for the system as well as components used in it.

Diagnostic information derived when either the embodiment of FIG. 4 or 5 is in use, can be used for driver and service information. It can also be used for actively changing the functioning of the system to enable continued use of the vehicle in a so-called limp home mode in case of an identified system malfunction. Examples of changing functions are modifying valve functions, shutting off the active system pressurizing by the turbo charger, reduction of available engine power and heat dissipation, and altered cooling fan, speed and fan-clutch engagement.

Operation

In operation from cold engine start up, operation of the turbo charger will transmit air under pressure through the conduit 26 to the expansion tank 18. Assuming the pressure relief setting of the cap pressure relief valve 24 is high enough, air under pressure will flow through the flow control valve 34 until pressure in the expansion tank 18 is approaching the relief valve opening pressure (but not higher). Should the pressure of air from the turbo charger 16 drop, the one way flow control valve 34 will prevent a pressure drop in the expansion tank 18.

With the embodiment of FIG. 3, the second non-return flow valve 35 functions to reduce the pressure in the coolant system when outlet pressure from the turbo charger is reduced, but not lower than the pre-set opening pressure of the second flow control valve 35.

With the embodiment of FIG. 4, the directional control valve 38 functions to prevent automatic pressure decay in the expansion tank to maintain higher pressure when the engine load and the pressure of the engine intake system is reduced. The electronic control unit 40 of the FIG. 4 embodiment, will function based on the parameters that have been selected to control pressure decay in the coolant system.

With the embodiment of FIG. 4, pressure in the coolant system in relation to pressure in the engine air inlet 15 is totally controlled by the one way directional control valve 42 which in turn is controlled by the electronic control unit 46. This functioning is in accordance with the parameters that have been described.

The embodiment of FIG. 5 is effective to control coolant system pressure appropriate for operating parameters and as such to maximize performance benefits of a pressurized cooling system.

Electronic Controlled Coolant System with Modulated Pressurization

Figure 6:
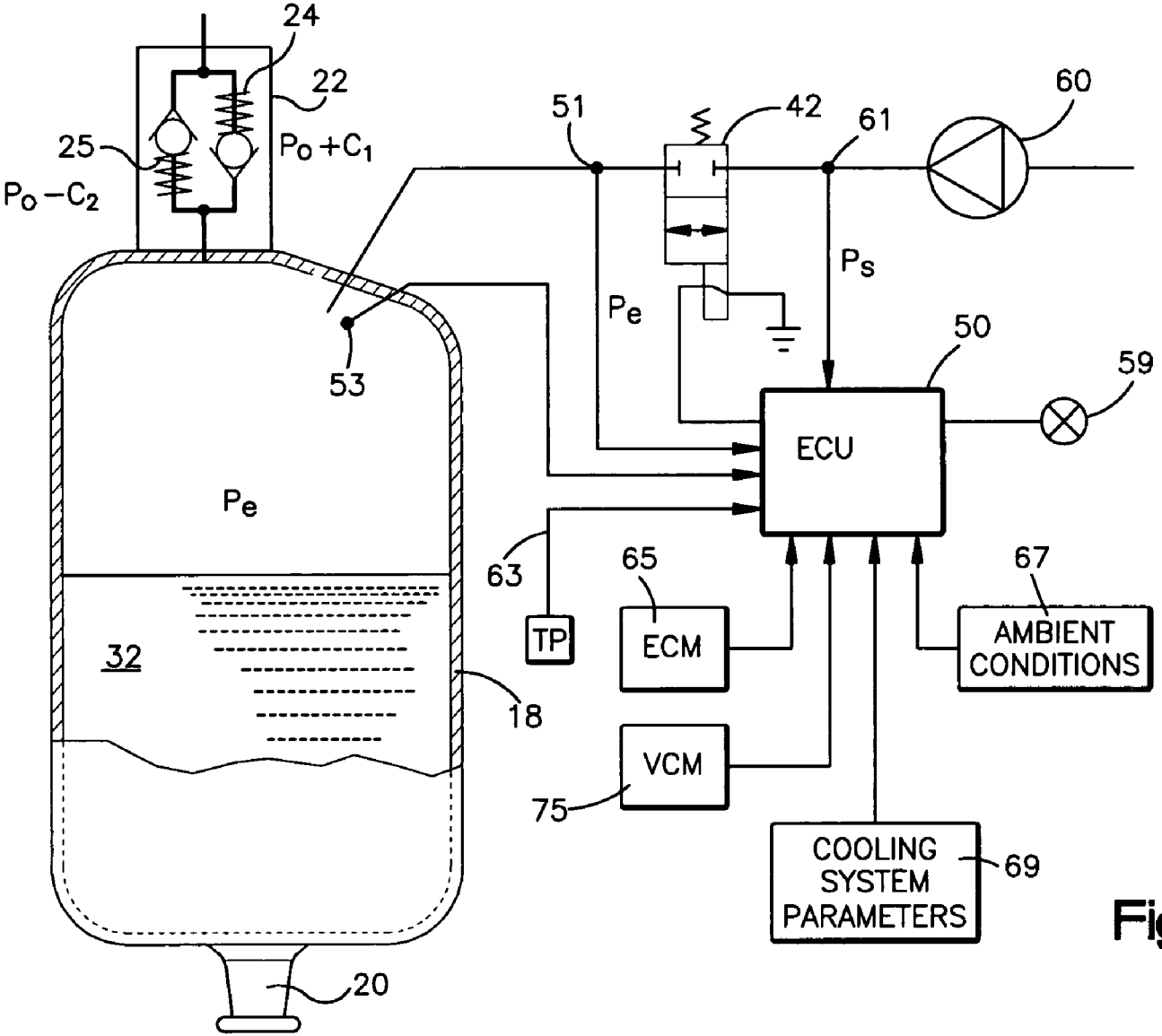
FIG. 6 is a schematic view of yet another alternate flow control valving arrangement for the system of FIG. 2.

FIG. 6 is a schematic diagram of coolant pressure control system that includes a tank pressure sensor 51, electronically controlled bidirectional flow control valve 42, and an electronic control unit (ECU) 50 for controlling the flow control valve. The pressure cap 22 operates as discussed above and maintains pressure between two absolute limits $P_0-C_2$ and $P_0+C_1$, where $P_0$ is an estimated optimal pressure that is based on nominal operating conditions, and $C_1$ and $C_2$ are the calibration levels of the vacuum valve 25 and the pressure relief valve 24, respectively. The conduit and tank inlet are shown schematically in FIG. 6, but are similar in appearance and operation to that shown in FIG. 2. A pressure source 60, such as the manifold 15 shown in FIG. 2, is connected to the bidirectional valve 42. In the embodiment shown in FIG. 6, the floating check valve assembly 30 (FIG. 2) has been suitably replaced with an electronic tank level sensor 53 that sends signals indicative of tank level to the ECU 50.

The pressure sensor 51 measures the system pressure, $P_e$, within the tank. This tank pressure is input to the ECU 50. The ECU also receives signals indicative of pressure source pressure level, $P_s$, from pressure sensor 61. The ECU continually calculates a real time optimal pressure, $P_{0rt}$, for the system based on present vehicle operating conditions. A control range that is a function of the calculated $P_{0rt}$ is stored in the ECU. The control range is an amount of allowed deviation from any given $P_{0rt}$. The control range is suitably selected to maintain the system pressure within the absolute limits $P_0-C_2$ and $P_0+C_1$ dictated by the components of the pressure cap 22. Using the control range and the calculated $P_{0rt}$, the ECU determines a target pressure range. When the system pressure, $P_e$, is outside the target range, the ECU controls the valve 42 to supply or bleed pressure by allowing flow between the pressure source 60 to the tank. In addition, the ECU controls the valve to prevent flow from the tank to the pressure source when the level sensor 53 indicates a high tank level. Of course, if at any time the pressure of the system falls outside the absolute limits of the pressure cap, the pressure cap will operate to connect the coolant system to the ambient atmosphere.

The ECU calculates $P_{0rt}$ for the system based on a number of factors. These factors include present engine operating conditions such as engine load and speed as sensed by the engine control module, or ECM, 65; coolant temperature as sensed by temperature probe 63 which is suitably positioned in an area through which coolant flows; ambient conditions as sensed by various sensors indicated generally as 67; vehicle operating parameters such as road speed as sensed by the vehicle control module, or VCM, 75; and cooling system parameters 69 such as coolant type, and/or specific properties of materials used in the cooling system. The cooling system parameters may be stored in the ECU at vehicle assembly and changed during subsequent vehicle service as necessary. These parameters included cooling fan speed, duty cycle, and system capacity. $P_{0rt}$ and its associated target range are calculated to provide stable engine and cooling system performance such that, for example, unwanted coolant boiling and coolant discharge at elevated coolant temperatures and pump cavitation are prevented at a wide range of temperatures. The ECU 50 controls the valve 42 to modulate the tank pressure to provide sufficient pressure to the system with a minimum of scavenging of air through the valve 42. If tank pressure is higher than the target range, the ECU 50 may open the valve to relieve the pressure to reduce material stresses in the system. The pressure differential between the pressure at the pressure source $P_s$ and the pressure within the cooling system $P_e$ determines the direction of flow through the valve.

Figure 7:
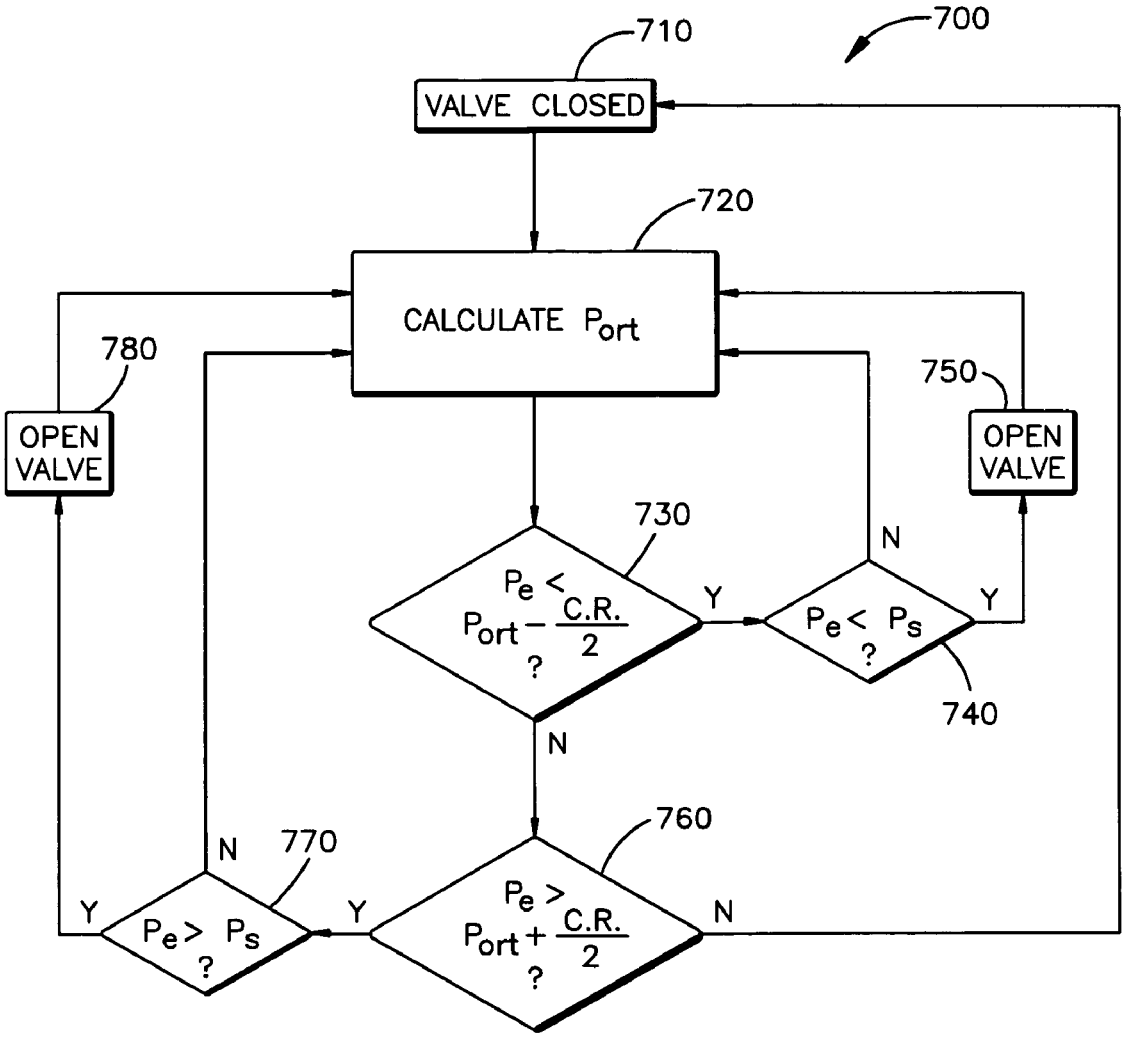
FIG. 7 is a flowchart depicting a control method according to one embodiment of the present invention.

Referring now to FIG. 7, one possible method 700 for controlling the operation of the valve 42 is illustrated in flowchart form. In general, the optimum pressure, $P_{0rt}$, is periodically calculated as conditions change. The optimum pressure $P_{0rt}$ and the associated control range are selected to provide stable engine and cooling system function under a wide range of operating conditions and to prevent or limit coolant boiling and discharge at elevated coolant temperatures, pump cavitation, and cavitation erosion. A control range (C.R. in FIG. 7) for pressure that varies as a function of the calculated $P_{0rt}$ is stored in the ECU. The control range can be a continuous or step-wise function, or a set of discrete control points, or any other function that results in a target pressure range that controls stability and minimizes scavenging of air through the enclosure. For example, at certain optimum pressures, it will be possible to maintain a "looser" control over the system pressure to minimize valve operation and potential scavenging of air. At other optimum pressures, it may be desirable to specify a "tighter" control range to more closely regulate pressure even if it results in some scavenging of air.

The method 700 will now be described in greater detail. The valve is normally closed as indicated in 710. At 720 a real time optimal pressure $P_{0rt}$ is calculated based on the parameters discussed above. At 730, the system pressure Pe is compared to the lower point of the target range at the optimal pressure ($P_{0rt}$−C.R./2). If the system pressure is not below this point, it is compared to the upper limit ($P_{0rt}$+C.R./2) at 760. If the system pressure is within the lower and upper points of the target range, the method returns and the valve is at the closed position (710). If, however, the system pressure $P_e$ is below the target range at 730, the method checks the system pressure $P_e$ at 740 to determine if it is at a lower pressure than the pressure source pressure $P_s$. If $P_e$ is less than $P_s$, then the valve is opened at 750 to raise the system pressure $P_e$. The method loops through 720–750 until $P_e$ is raised into the target range. At 740, if $P_e$ is not less than $P_s$, then opening the valve will not raise $P_e$ and the valve is not opened. In this case the method returns to 720 where a new $P_{0rt}$ is calculated and if $P_e$ falls below the absolute limit of the pressure cap, the pressure cap will vent from atmosphere.

Likewise, if the system pressure $P_e$ is higher than the upper control limit at 760, the system pressure $P_e$ is compared to the pressure source pressure PS at 770 to determine if $P_e$ is higher than $P_s$. If $P_e$ is higher than the system pressure $P_s$, the valve is opened at 780 to vent to the pressure source. The method loops until $P_e$ is lowered into the target range. At 770 if $P_e$ is already lower than $P_s$ opening the valve will not lower $P_e$, so the method returns to 720. If $P_e$ increases to a level above the absolute limit of the pressure cap, the pressure cap will vent to atmosphere. The method described above is but a single example of suitable control algorithms for implementing the inventive cooling system and other possible algorithms will be apparent to those of skill in the art.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and scope of the invention as hereinafter claimed.

I claim:

1. An apparatus for controlling an engine cooling system pressure comprising:

an expansion tank for collecting coolant liquid;

a conduit in fluid communication with the expansion tank for supplying gas under pressure from an external pressure source to pressurize the cooling system; and a valve between the expansion tank and the external pressure source, said valve including a device disposed in the expansion tank that is responsive to a level of coolant liquid in the expansion tank to actuate the valve to block back flow of coolant liquid to the external pressure source when the level of coolant liquid rises to a threshold level.

2. The apparatus of claim 1 wherein the external pressure source comprises an engine air intake manifold.

3. The apparatus of claim 1 wherein the apparatus comprises a pressure relief valve for maintaining pressure in the cooling system below a predetermined maximum cooling system pressure limit.

4. The apparatus of claim 1 wherein the apparatus comprises a vacuum valve for maintaining pressure in the cooling system above a predetermined minimum cooling system pressure limit.

5. The apparatus of claim 1 wherein the device disposed in the expansion tank valve comprises a floating check valve.

6. The apparatus of claim 1 comprising a valve controller for controlling the valve and wherein the device disposed in the expansion tank comprises a coolant liquid level probe connected to send signals indicative of coolant liquid level to the valve controller.

7. The apparatus of claim 1 wherein the valve is controlled by an electronic valve controller that calculates an optimum cooling system pressure and wherein the apparatus comprises a cooling system pressure sensor for sending signals indicative of cooling system pressure to the electronic valve controller.

8. The apparatus of claim 7 wherein the electronic valve controller calculates the optimum cooling system pressure based on present vehicle operating conditions.

9. The apparatus of claim 7 wherein the electronic valve controller calculates the optimum cooling system pressure based on cooling system parameters that are stored in the electronic valve controller.

10. The apparatus of claim 7 wherein the electronic valve controller calculates the optimum cooling system pressure based on ambient conditions.

11. The apparatus of claim 7 wherein the electronic valve controller actuates the valve to maintain cooling system pressure below a predetermined upper pressure setpoint that is based on the calculated optimum cooling system pressure.

12. The apparatus of claim 7 wherein the electronic valve controller actuates the valve to maintain cooling system pressure above a predetermined lower pressure setpoint that is based on the calculated optimum cooling system pressure.

13. The apparatus of claim 7 wherein the electronic valve controller actuates the valve to maintain cooling system pressure at the calculated optimum cooling system pressure.

14. An apparatus for controlling an engine cooling system pressure comprising:

an expansion tank for collecting coolant liquid;

a conduit in fluid communication with the expansion tank for supplying gas under pressure from an external pressure source to pressurize the cooling system;

a valve between the expansion tank and the external pressure source to selectively place the expansion tank in fluid communication with the external pressure source, and an electronic controller connected to send control signal to actuate the valve.

15. The apparatus of claim 14 comprising a coolant level sensor disposed in the expansion tank and in electrical communication with the electronic controller for sending a signal to the electronic controller indicative of a level of coolant in the tank and wherein the electronic controller controls the valve to disconnect the external pressure source from the expansion source when the coolant level reaches a predetermined level.

16. The apparatus of claim 14 comprising a pressure sensor for measuring a pressure level in the expansion tank and for sending signals indicative of the pressure level to the electronic controller.

17. The apparatus of claim 16 wherein the electronic controller selectively places the external pressure source in fluid communication with the expansion tank to maintain the sensed pressure within a predetermined pressure range.

18. The apparatus of claim 17 wherein the predetermined pressure range is calculated based on present vehicle operating conditions.

19. The apparatus of claim 17 wherein the predetermined pressure range is calculated based on cooling system parameters that are stored in the electronic controller.

20. The apparatus of claim 17 wherein the predetermined pressure range is calculated based on ambient conditions.

21. A method that controls a valve interposed between a coolant expansion tank and a pressure source comprising:

monitoring an actual cooling system pressure;

calculating a range of optimal system pressures based on current operating conditions;

comparing the actual cooling system pressure to the optimal system pressure; and when the actual cooling system pressure is below the range of optimal system pressures, opening the valve to connect the coolant expansion tank to the pressure source.

22. The method of claim 21 wherein the range of optimal system pressures is calculated based on vehicle cooling system parameters.

23. The method of claim 21 wherein the range of optimal system pressures is calculated based on ambient conditions.

24. The method of claim 21 wherein the magnitude of the range of optimal al pressures varies based on a calculated optimum pressure.

25. The method of claim 21 comprising opening the valve to connect the coolant expansion tank to the pressure source when the actual cooling system pressure is above the range of optimal system pressures and a pressure of the pressure source.

26. The method of claim 21 comprising monitoring a coolant tank level and preventing opening of the valve if the coolant tank level is above a predetermined level.

* * * * *